US006445350B2

(12) United States Patent
Takenobu

(10) Patent No.: US 6,445,350 B2
(45) Date of Patent: Sep. 3, 2002

(54) TERMINAL DEVICE FOR A GLASS ANTENNA

(75) Inventor: Shotaro Takenobu, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/785,169

(22) Filed: Feb. 20, 2001

(30) Foreign Application Priority Data

Feb. 24, 2000 (JP) ..... 2000-047774

(51) Int. Cl.[7] ..... H01Q 1/32; H01R 13/58
(52) U.S. Cl. ..... 343/713; 343/906; 439/606
(58) Field of Search ..... 343/713, 702, 343/715, 906; 439/606, 721, 722, 916; H01Q 1/32; H01R 13/58

(56) References Cited

U.S. PATENT DOCUMENTS 5,470,238 A * 11/1995 Walden ..... 439/98
5,490,785 A * 2/1996 Hein et al. ..... 439/76.1
5,619,012 A * 4/1997 Casali et al. ..... 174/52.2
5,664,964 A * 9/1997 Crofoot et al. ..... 439/495
5,926,952 A * 7/1999 Ito ..... 29/883
6,068,523 A * 5/2000 Takahashi ..... 439/736
6,142,803 A * 11/2000 Bozzer et al. ..... 439/188

FOREIGN PATENT DOCUMENTS

| | | |
|---|---|---|
| JP | 3-97209 | 10/1991 |
| JP | 4-59607 | 5/1992 |
| JP | 4-116366 | 10/1992 |
| JP | 5-14029 | 1/1993 |
| JP | 5-15515 | 2/1993 |
| JP | 5-191124 | 7/1993 |
| JP | 5-76107 | 10/1993 |
| JP | 7-7211 | 1/1995 |
| JP | 7-336125 | 12/1995 |
| JP | 8-330835 | 12/1996 |
| JP | 9-76747 | 3/1997 |

* cited by examiner

*Primary Examiner*—Don Wong
*Assistant Examiner*—Trinh Vo Dinh
(74) *Attorney, Agent, or Firm*—Oblon, Spivak, McClelland, Maier & Neustadt, P.C.

(57) ABSTRACT

A terminal device for a glass antenna suitable for housing and connecting a four-terminal circuit wherein embedded portions of metallic legs are respectively electrically connected to two input terminals of a four-terminal circuit on a circuit substrate, a connector holder is provided on a portion of a resin-molded body above the embedded portion, and connector electrodes are respectively connected to two output terminals of the four-terminal circuit.

9 Claims, 4 Drawing Sheets

TERMINAL DEVICE FOR A GLASS ANTENNA

BACKGROUND OF THE INVENTION

1. Field of the Invention

The present invention relates to a terminal device for a glass antenna, which is suitable for housing and connecting a four-terminal circuit.

2. Discussion of Background

Conventionally, a metallic terminal device as shown in FIG. 8 was used for a glass antenna (Japanese Patent No. 2,775,764). The metallic terminal device has a circuit substrate inside thereof, and is fixed by solder 21 to an antenna pattern 20 provided on a window glass sheet 13. A female connector 22 is attachable to a terminal piece 24 so that a received signal from the antenna pattern 20 is supplied to a receiver (not shown) through a two-terminal circuit provided on the circuit substrate and a cable 23.

In the conventional technique, however, there was a problem as follows. Since the body of the metallic terminal device was made of metal in its entirety, both legs are short-circuited, and if the circuit provided on the circuit substrate is a four-terminal circuit, the both legs could not be used as separated terminals, whereby two output terminals of the four-terminal circuit could not be connected respectively to two input terminals provided at a side of the receiver.

SUMMARY OF THE INVENTION

It is an object of the present invention to provide a terminal device for a glass antenna to eliminate the above-mentioned disadvantage in the conventional technique.

According to the present invention, there is provided a terminal device for a glass antenna comprising a resin-molded body (1), metallic legs (2), (3) provided respectively at both sides of the resin-molded body (1), a circuit substrate (6) provided in the resin-molded body (1), a connector holder (4) and connector electrodes (5*a*), (5*b*) provided in the connector holder (4), the terminal device for a glass antenna being characterized in that the metallic legs (2), (3) have respectively embedded portions (2*b*), (3*b*) embedded in the resin-molded body (1); the embedded portions (2*b*), (3*b*) are respectively electrically connected to two input terminals of a four-terminal circuit provided on the circuit substrate (6); the connector holder (4) is provided on a portion of the resin-molded body (1) above the embedded portion (3*b*); and the connector electrodes (5*a*), (5*b*) are respectively connected to two output terminals of the four-terminal circuit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Figure 1:
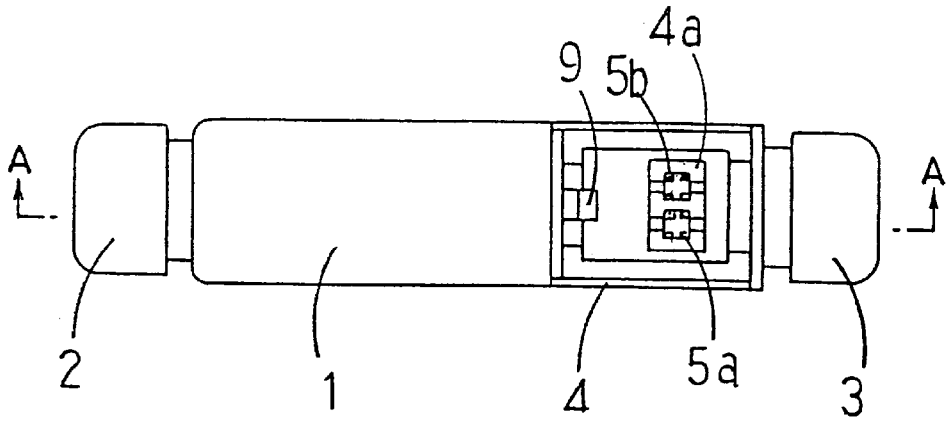
FIG. 1 is a plain view of an embodiment of the terminal device for a glass antenna of the present invention.
Figure 2:
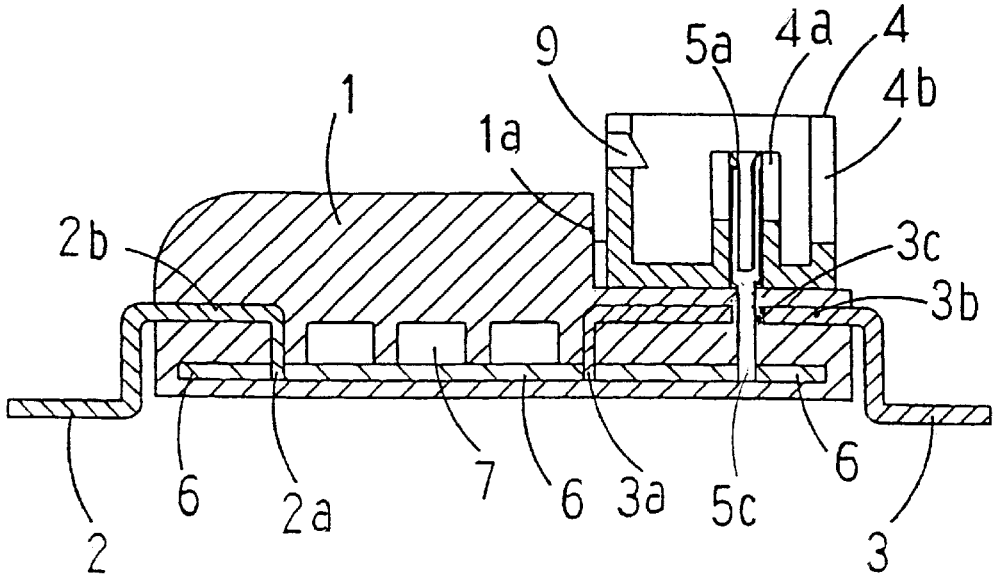
FIG. 2 is a cross-sectional view taken along a line A—A in FIG. 1.

The present invention will be described in detail with reference to the drawings. FIG. 1 is a plain view of the terminal device for a glass antenna according to an embodiment of the present invention, and FIG. 2 is a cross-sectional view taken along A—A in FIG. 1. In the following description, directions indicate those in the surface of the papers on which the figures are shown, unless specifically mentioned.

As shown in FIGS. 1 and 2, the terminal device for a glass antenna as an embodiment of the present invention comprises a resin-molded body 1, metallic legs 2, 3 provided respectively at both sides of the resin-molded body 1, a circuit substrate 6 provided inside of the resin-molded body 1, a connector holder 4, and connector electrodes 5*a*, 5*b* located in the connector holder 4. A four-terminal circuit is provided on the circuit substrate 6.

The metallic leg 2 is made of a metallic sheet, and is provided with an embedded portion 2*b* embedded in the resin-molded body 1. In the terminal device for a glass antenna shown in FIGS. 1 and 2, the embedded portion 2*b* is substantially horizontal, and is so formed that the metallic leg 2 is once extended out of the resin-molded body 1 from the embedded portion 2*b* in a direction substantially opposite to a side of the metallic leg 3; is bent substantially downward at the end of the extension, and is further bent in a substantially horizontal direction. Such portion extending substantially horizontally is referred to as a horizontal portion of the metallic leg 2.

The metallic leg 2 is bent substantially downward at a portion of the embedded portion 2*b* at a side of the metallic leg 3, and the free end portion 2*a* of the metallic leg 2 at a side of the circuit substrate 6 is connected electrically to one of input terminals of the four-terminal circuit. In the terminal device for a glass antenna shown in FIGS. 1 and 2, the free end portion 2*a* of the metallic leg 2 at the side of the circuit substrate 6 is processed to be thin, and the free end portion 2*a* is inserted into a through hole formed in the circuit substrate 6, and connected electrically to one of the input terminals of the four-terminal circuit by solder.

The metallic leg 3 is made of a metallic sheet, and is provided with an embedded portion 3*b* embedded in the resin-molded body 1. In the terminal device for a glass antenna shown in FIGS. 1 and 2, the embedded portion 3*b* is substantially horizontal, and is so formed that the metallic leg 3 is once extended out of the resin-molded body 1 from the embedded portion 3*b* in a direction substantially opposite to a side of the metallic leg 2; is bent substantially downward at the end of the extension, and is further bent in a substantially horizontal direction. Such portion extending substantially horizontally is referred to as a horizontal portion of the metallic leg 3.

Figure 3:
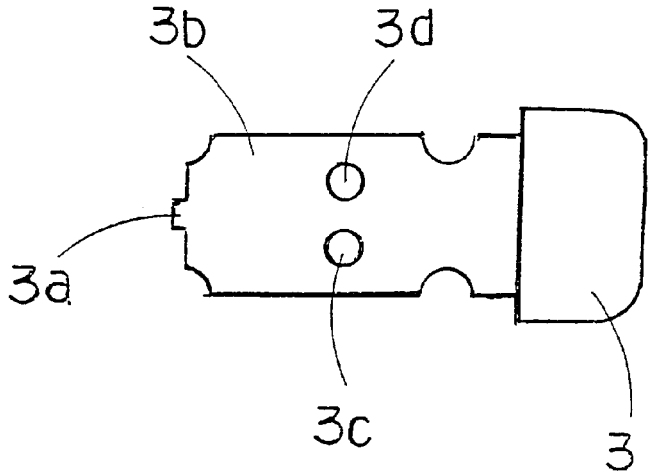
FIG. 3 is a plain view of a metallic leg 3.

The metallic leg 3 is bent substantially downward at a portion of the embedded portion 3*b* at a side of the metallic leg 2, and the free end portion 3*a* of the metallic leg 3 at the side of the circuit substrate 6 is connected electrically to the other of input terminals of the four-terminal circuit. In the terminal device for a glass antenna shown in FIGS. 1 and 2, the free end portion 3*a* is processed to be thin, and is inserted into another through hole formed in the circuit substrate 6 and is connected electrically to the other of the input terminals of the four-terminal circuit by solder. FIG. 3 is a plain view of the metallic leg 3 wherein reference numeral 3*c* designates a through hole formed in the embedded portion 3*b,* and reference numeral 3*d* designates the other through hole formed separate from the through hole 3*c* in the embedded portion 3*b.*

Figure 4:
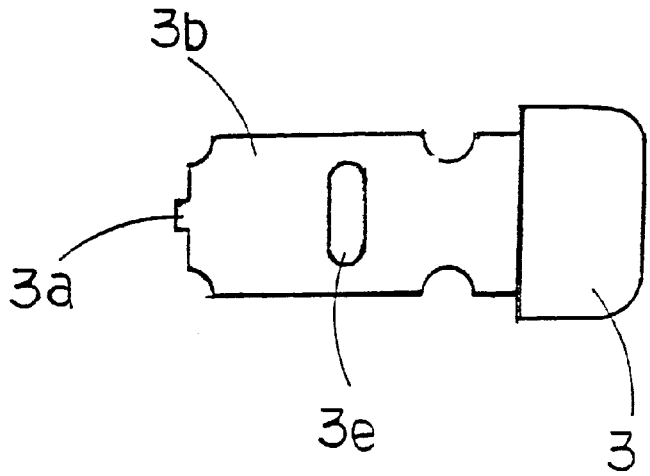
FIG. 4 is a plain view of a metallic leg 3 as another embodiment different from that shown in FIG. 3.

FIG. 4 is a plain view of another embodiment of the metallic leg 3 which is different from that of FIG. 3. The metallic leg 3 shown in FIG. 4 is provided with a through hole 3*e*. The opening of the through hole 3*e* has an elongated shape in a direction substantially perpendicular to a longitudinal direction of the metallic leg 3.

In the terminal device for a glass antenna shown in FIGS. 1 and 2, the resin-molded body 1 is substantially rectangular when it is observed from an upper side, and the circuit substrate 6 is also substantially rectangular. The circuit substrate 6 is disposed in the resin-molded body 1 so that a longitudinal direction of the substrate 6 is in common with that of the resin-molded body 1, and is extended from a lower portion of the embedded portion 2*b* to a lower portion of the embedded portion 3*b*. Circuit elements 7 arranged on the circuit substrate 6 are electrical parts for the four-terminal circuit. As the four-terminal circuit, an impedance matching circuit, a preamplifier circuit, a resonance circuit and so on are mentioned.

The highest portion of the resin-molded body 1 above the embedded portion 2*b* is higher than the highest portion of the resin-molded body 1 above the embedded portion 3*b,* and a step portion 1*a* is formed between a portion of the resin-molded body 1 above the embedded portion 2*b* and a portion of the resin-molded body 1 above the embedded portion 3*b*. A bottomed frame-like connector holder 4 is disposed on a portion of the resin-molded body 1 above the embedded portion 3*b*.

In the connector holder 4, a connector column portion 4*a* which is extended upward from the bottom portion of the connector holder 4 is provided. In the terminal device for a glass antenna shown in FIGS. 1 and 2, the connector column portion 4*a* comprises three column-like bodies, and the connector electrodes 5*a,* 5*b* are respectively provided in spaces formed by the three column-like bodies. A lower portion 5*c* of the connector electrode 5*a* is extended downward by passing through the through hole 3*c* formed in the embedded portion 3*b*. Further, the end of the lower portion 5*c* reaches the circuit substrata 6 to enter into a through hole formed in the circuit substrate 6 so that the lower portion 5*c* is connected electrically to one of output terminals of the four-terminal circuit by solder. Similarly, the end of a lower portion (not shown) of the connector electrode 5*b* is extended downward by passing through the through hole 3*d* formed in the embedded portion 3*b* to enter into a through hole formed in the circuit substrate 6 so that the lower portion is connected electrically to the other output terminal of the four-terminal circuit by solder.

Alternatively, both the lower portion 5*c* of the connector electrode 5*a* and the lower portion of the connector electrode 5*b* may be passed through the through hole 3*e* formed in the embedded portion 3*b* to reach the circuit substrate 6 as shown in FIG. 4.

Figure 5:
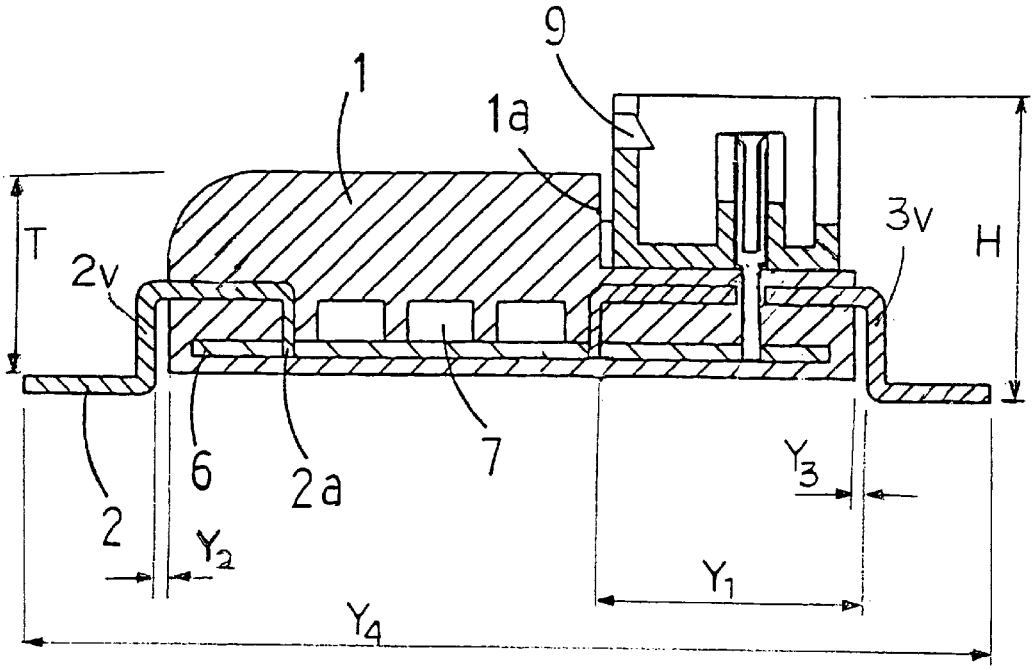
FIG. 5 is a cross-sectional view showing the dimensions of the terminal device for a glass antenna shown in FIG. 1.

FIG. 5 is a cross-sectional view showing the dimensions of the terminal device for a glass antenna shown in FIG. 1. In FIG. 5, it is preferable that the height H of the terminal device for a glass antenna is 10–20 mm.

When the height H is 10 mm or more, a portion of the resin-molded body 1 below the connector holder 4 has an appropriate thickness to possess a large strength, and at the same time, an inner portion of the opening of the connector holder 4 has a sufficient depth whereby a connector, at a side of the receiver, fitted to the connector holder 4 is prevented from coming off easily. When the height is 20 mm or less, it contributes to miniaturization.

It is preferable that the free end portion 3*a* is located at a side of the metallic leg 2 with respect to the lower portion 5*c*. When the free end portion 3*a* is located at the side of the metallic leg 2 with respect to the lower portion 5*c,* the strength of the terminal device for a glass antenna of this embodiment against a force applicable from an upper side can be increased in comparison with a case that the free end portion 3*a* is located at a side of a vertical portion 3*v* of the metallic leg 3 with respect to the lower portion 5*c*.

Further, it is preferable that the distance $Y_1$ between the vertical portion 3*v* and the free end portion 3*a* is 3.5–20.0 mm. When the distance $Y_1$ is 3.5 mm or more, the length of the embedded portion 3*b* in left and right directions (hereinbelow, referred to as simply the length of the embedded portion 3*b*) in FIG. 2 is increased, and the strength of the terminal device for a glass antenna of this embodiment against a force applicable from an upper side can be increased in comparison with a case that the distance $Y_1$ is less than 3.5 mm.

When the distance $Y_1$ is 20.0 mm or less, the length $Y_4$ of the terminal device for a glass antenna of the present invention shown in FIG. 2 can be reduced to contribute to miniaturization. A further preferable range of the distance $Y_1$ is 5.7–16.7 mm, and an especially preferable range is 9.5–15.0 mm.

In order to keep the strength of the metallic leg 2, it is preferable that the distance $Y_2$ between an end of the resin-molded body 1 at a side of the metallic leg 2 and a vertical portion 2*v* of the metallic leg 2 is preferably 5.0 mm or less. In order to keep the strength of the metallic leg 3, the distance $Y_3$ between an end of the resin-molded body 1 at a side of the vertical portion 3*v* and the vertical portion 3*v* is preferably 5.0 mm or less.

The length $Y_4$ of the terminal device for a glass antenna of the present invention is preferably in a range of 30–60 mm. When the length $Y_4$ is 30 mm or more, a sufficient surface area of the circuit substrate 6 can be obtained, and when the length $Y_4$ is 60 mm or less, it contributes to miniaturization.

The thickness T in a vertical direction of the resin-molded body 1 in the vicinity of the embedded portion 2*b* is preferably 6.0 mm or more in order to keep the overall strength of the terminal device for a glass antenna of the present invention. Further, it is preferable that the highest portion of the resin-molded body 1 is lower than the highest portion of the connector holder 4 in order to reduce the size of the terminal device for the glass antenna of the present invention.

Figure 6:
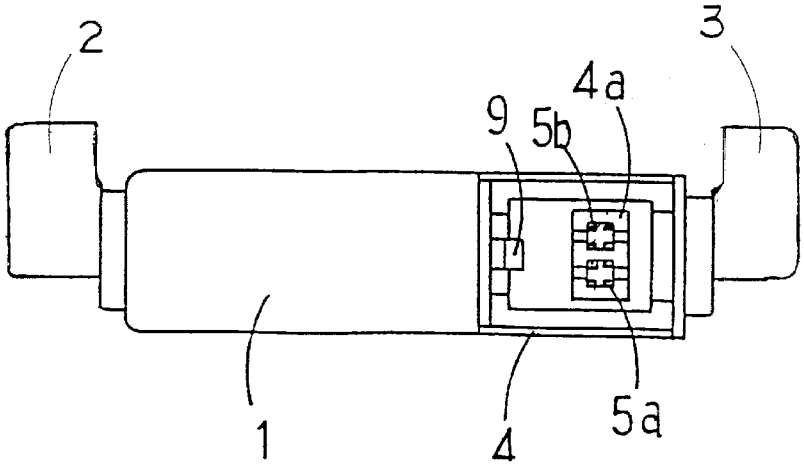
FIG. 6 is a plain view of another embodiment of the terminal device different from that shown in FIGS. 1 and 2.

FIG. 6 is a plain view showing another embodiment of the present invention which is different from the embodiment shown in FIGS. 1 and 2, wherein the shape of the metallic legs 2, 3 is modified. In FIG. 6, a horizontal portion of the metallic leg 2 and a horizontal portion of the metallic leg 3 are extended to a direction substantially perpendicular to a longitudinal direction of the terminal device for a glass antenna of this embodiment. The reason why the shape of the horizontal portion of the metallic leg 2 and the shape of the horizontal portion of the metallic leg 3 are changed is to prevent the contact of the resin-molded body 1 or the connector holder 4 with an obstacle such as an inner accessory for fixing the terminal device if such obstacle exists just above the antenna pattern formed on the window glass sheet.

Figure 7:
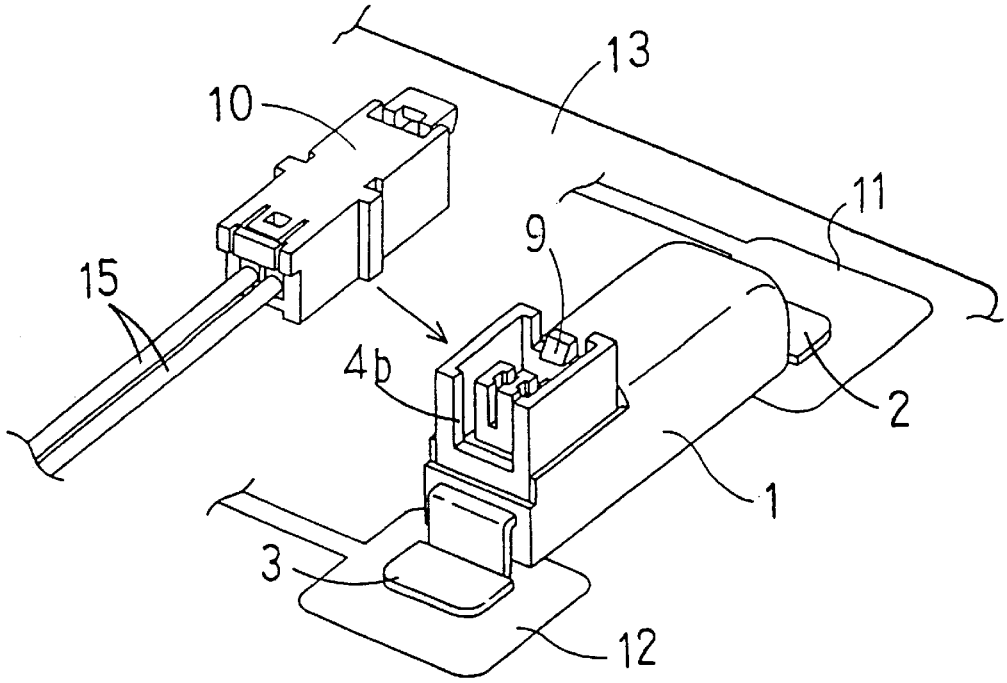
FIG. 7 is a perspective view showing how to use the terminal device for a glass antenna according to the present invention.
Figure 8:
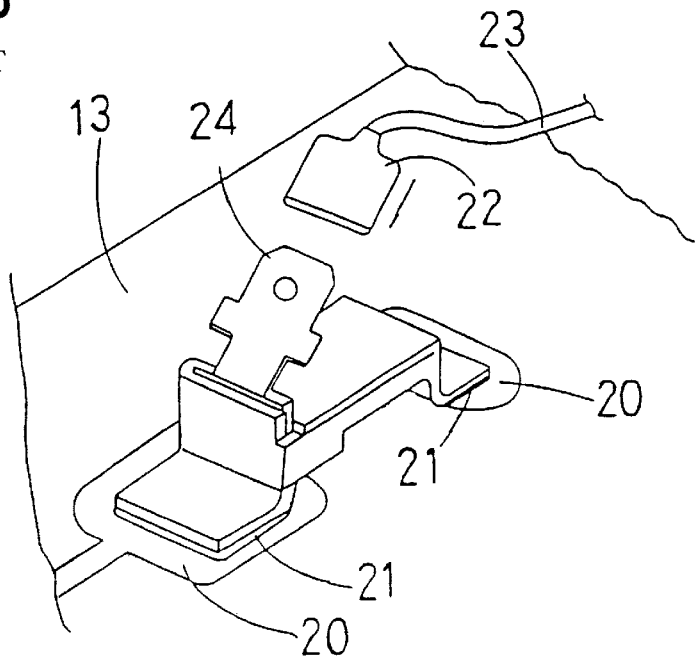
FIG. 8 PRIOR ART
FIG. 8 is a perspective view of a conventional terminal device for a glass antenna.

FIG. 7 shows a state of using the terminal device for a glass antenna of the present invention. A connector 10 provided at a side of the receiver, which is capable of fitting to the connector holder 4, is connected to the connector holder 4. The connector 10 at the side of the receiver has two electrodes of different poles (not shown) which are respectively connected electrically to the connector electrodes 5*a*, 5*b* so that received signals at the two output terminals of the four-terminal circuit are supplied to the receiver (not shown) through the cable 15.

A pawl portion 9 is formed in an inner side face of the connector holder 4 at a side of the metallic leg 2. When the connector 10 at the side of the receiver is inserted into the connector holder 4, the pawl portion 9 fixes the connector 10 at the side of the receiver. A notch portion 4*b* is formed in a side wall of the connector holder 4 at a side of the metallic leg 3 so that the connector 10 can be inserted into the connector holder 4. A notch portion 4*b* is formed in a side wall of the connector holder 4 at a side of the metallic leg 3 so that the connector 10 can be inserted into the connector holder 4.

As material for the resin-molded body 1 and the connector holder 4, synthetic resin having high insulation properties is preferred. In particular, liquid crystal polymer is more preferable because it is excellent in heat resistance and less shrinkage by heat.

The present invention will be described in detail with reference to Example. However, it should be understood that the present invention is by no means restricted by such specific example.

EXAMPLE

The terminal device for a glass antenna as shown in FIG. 1 was prepared. Liquid crystal polymer was used as material for the resin-molded body 1, and PPS (polyphenylenesulfide) was used as material for the connector holder 4. The dimension and fixed number of each portion are as follows.

| | |
|---|---|
| Height H: | 14.10 mm |
| Distance $Y_1$: | 11.55 mm |
| Distance $Y_2$: | 0.75 mm |
| Distance $Y_3$: | 0.75 mm |
| Length $Y_4$: | 43.00 mm |
| Thickness T: | 10.15 mm. |

The terminal device for a glass antenna was fixed to an antenna pattern 11, 12 (FIG. 7) formed on a window glass sheet 13 by solder. As a result, excellent fitting could be achieved.

In the present invention, since the metallic legs 2, 3 are not short-circuited by the presence of the resin-molded body 1, the legs can be used as separate terminals even when the circuit provided on the circuit substrate is a four-terminal circuit, whereby two output terminals of the four-terminal circuit can be connected to two input terminals at the side of the receiver respectively.

The entire disclosure of Japanese Patent Application No. 2000-47774 filed on Feb. 24, 2000 including specification, claims, drawings and summary are incorporated herein by reference in its entirety.

What is claimed is:

1. A terminal device for a glass antenna comprising a resin-molded body, a first metallic leg and a second metallic leg provided respectively at both sides of the resin-molded body, a circuit substrate provided in the resin-molded body, a connector holder and a first connector electrode and a second connector electrode provided in the connector holder, said terminal device for a glass antenna being characterized in that:

the first metallic leg and the second metallic leg have respectively a first embedded portion and a second embedded portion embedded in the resin-molded body;

the first embedded portion and the second embedded portions are respectively electrically connected to two input terminals of a four-terminal circuit provided on the circuit substrate;

the connector holder is provided on a portion of the resin-molded body above the second embedded portion;

the first connector electrode and the second connector electrode are respectively connected to two output terminals of the four-terminal circuit, a highest portion of the resin-molded body above the first embedded portion is higher than a highest portion of the resin-molded body above the second embedded portion; and a step portion is formed between a portion of the resin-molded body above the first embedded portion and a portion of the resin-molded body above the second embedded portion.

2. The terminal device for the glass antenna according to claim 1, wherein:

a portion of the circuit substrate is provided below the connector holder;

the two output terminals of the four-terminal circuit are provided on said portion of the circuit substrate;

a lower portion of the first connector electrode is connected to one of the two output terminals of the four-terminal circuit; and a lower portion of the second connector electrode is connected to the other of the two output terminals of the four-terminal circuit.

3. The terminal device for a glass antenna according to claim 1, wherein the height of the terminal device for the glass antenna is 10–20 mm.

4. The terminal device for a glass antenna according to claim 1, wherein a free end portion of the second metallic leg at a side of the circuit substrate is provided at the same side as the first metallic leg with respect to a lower portion of the connector electrode.

5. The terminal device for a glass antenna according to claim 1, wherein:

the second metallic leg has a vertical portion bent substantially downward from an extension of the second embedded portion, which extends from the resin-molded body in a direction substantially opposite to a side of the first metallic leg, and the distance between the vertical portion and a free end portion of the metallic leg at a side of the circuit substrate is 3.5–20 mm.

6. The terminal device for a glass antenna according to claim 1, wherein:

the second embedded portion is provided with a first through hole and a second through hole;

a lower portion of the first connector electrode reaches the circuit substrate through the first through hole; and a lower portion of the second connector electrode reaches the circuit substrate through the second through hole.

7. The terminal device for a glass antenna according to claim 1, wherein:

the second embedded portion is provided with a through hole, and both a lower portion of the first connector electrode and a lower portion of the second connector electrode reach the circuit substrate through the through hole.

8. A terminal device for a glass antenna comprising a resin-molded body, a first metallic leg and a second metallic leg provided respectively at both sides of the resin-molded body, a circuit substrate provided in the resin-molded body, a connector holder and a first connector electrode and a second connector electrode provided in the connector holder, said terminal device for a glass antenna being characterized in that:

the first metallic leg and the second metallic leg have respectively a first embedded portion and a second embedded portion embedded in the resin-molded body;

the first embedded portion and the second embedded portions are respectively electrically connected to two input terminals of a four-terminal circuit provided on the circuit substrate;

the connector holder is provided on a portion of the resin-molded body above the second embedded portion;

the first connector electrode and the second connector electrode are respectively connected to two output terminals of the four-terminal circuit;

a lower portion of the first connector electrode reaches the circuit substrate through the first through hole; and a lower portion of the second connector electrode reaches the circuit substrate through the second through hole.

9. A terminal device for a glass antenna comprising a resin-molded body, a first metallic leg and a second metallic leg provided respectively at both sides of the resin-molded body, a circuit substrate provided in the resin-molded body, a connector holder and a first connector electrode and a second connector electrode provided in the connector holder, said terminal device for a glass antenna being characterized in that:

the first metallic leg and the second metallic leg have respectively a first embedded portion and a second embedded portion embedded in the resin-molded body;

the first embedded portion and the second embedded portions are respectively electrically connected to two input terminals of a four-terminal circuit provided on the circuit substrate;

the connector holder is provided on a portion of the resin-molded body above the second embedded portion;

the first connector electrode and the second connector electrode are respectively connected to two output terminals of the four-terminal circuit, the second embedded portion is provided with a through hole; and both a lower portion of the first connector electrode and a lower portion of the second connector electrode reach the circuit substrate through the through hole.

* * * * *